US005649401A

United States Patent [19]

Harrington, Jr.

[11] Patent Number: 5,649,401

[45] Date of Patent: Jul. 22, 1997

[54] FOAM AND CHANNEL CONCRETE FORM SYSTEM

[76] Inventor: James T. Harrington, Jr., 2620 NW. 111 St., Miami, Fla. 33167

[21] Appl. No.: 550,385

[22] Filed: Oct. 30, 1995

[51] Int. Cl.[6] ..... E04B 2/30; E04C 2/288

[52] U.S. Cl. ..... 52/426; 52/275; 52/562; 249/47; 249/194; 249/216

[58] Field of Search ..... 52/275, 272, 279, 52/426, 427, 442, 562, 561, 762; 249/216, 192, 194, 193, 47

[56] References Cited

U.S. PATENT DOCUMENTS

| | | | |
|---|---|---|---|
| 2,313,880 | 3/1943 | Leggett, Sr. | 249/194 |
| 3,611,664 | 10/1971 | Barbera | 52/562 X |
| 4,706,429 | 11/1987 | Young . | |
| 4,730,422 | 3/1988 | Young . | |
| 4,750,308 | 6/1988 | McKay . | |
| 4,765,109 | 8/1988 | Boeshart . | |
| 4,916,879 | 4/1990 | Boeshart . | |
| 4,924,641 | 5/1990 | Gibbar, Jr. | 52/275 X |
| 4,936,540 | 6/1990 | Boeshart . | |
| 4,938,449 | 7/1990 | Boeshart . | |
| 5,040,344 | 8/1991 | Durand . | |
| 5,371,990 | 12/1994 | Salah Uddin . | |
| 5,488,806 | 2/1996 | Melnick et al. | 52/426 X |

FOREIGN PATENT DOCUMENTS

| | | | |
|---|---|---|---|
| 670797 | 4/1952 | United Kingdom | 52/275 |

OTHER PUBLICATIONS

Diamond snap–form EPS forming system by AFM Corp. Excelsior, MN 55331 1994.

*Primary Examiner*—Carl D. Friedman
*Assistant Examiner*—Timothy B. Kang
*Attorney, Agent, or Firm*—Alvin S. Blum

[57] ABSTRACT

A prefabricated wall forming structure for constructing reinforced concrete walls employs insulating foam plastic panels that are interlocked into two parallel concrete impervious walls by I beam channels that are spaced apart by tie elements. The tie elements can support horizontal or vertical reinforcing bars and prevent the foam walls from spreading apart under the hydraulic force of the poured concrete. The I beams snugly engage the edges of the foam panels to provide a concrete imprevious seal and align the panels vertically and horizontally. A corner connector performs a similar function.

14 Claims, 1 Drawing Sheet

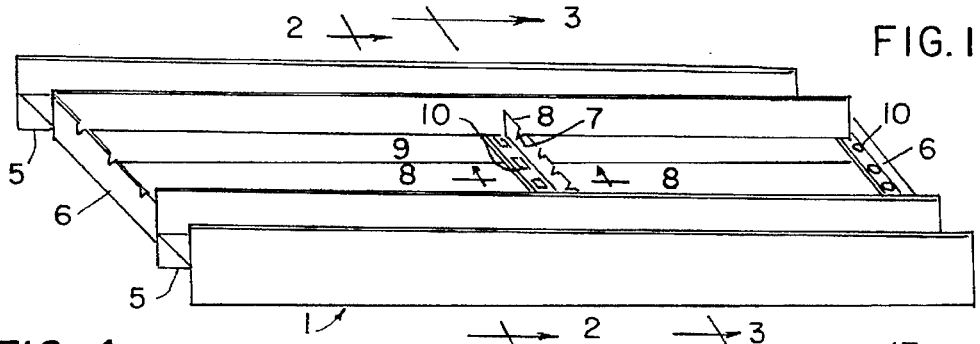
FIG. 1
FIG. 4
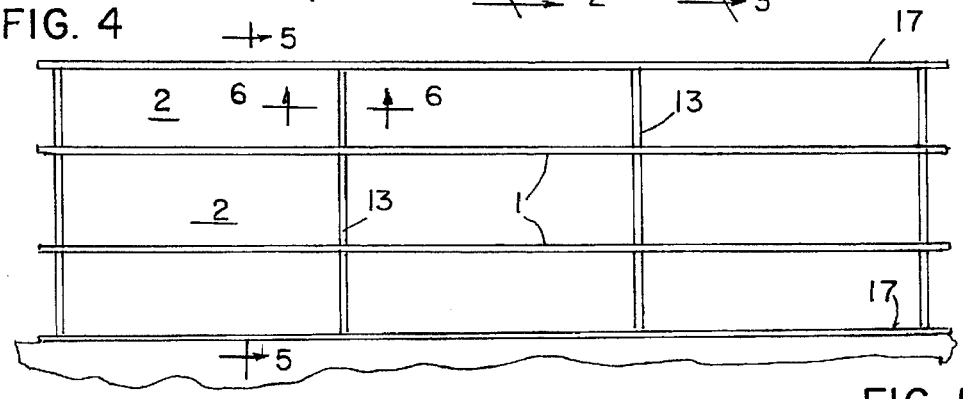
FIG. 5
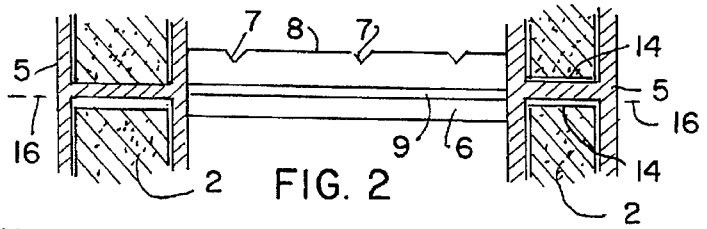
FIG. 2
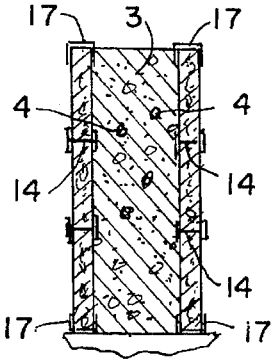
FIG. 6
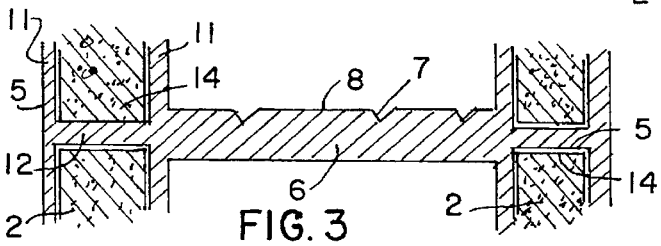
FIG. 3
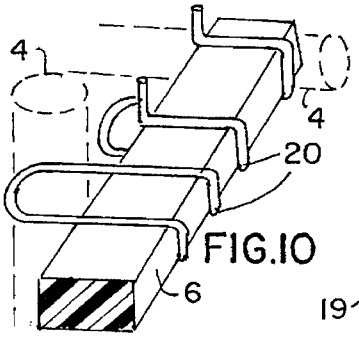
FIG.10
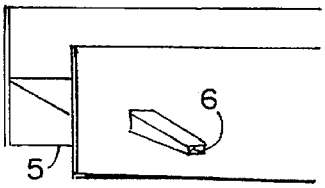
FIG. 9
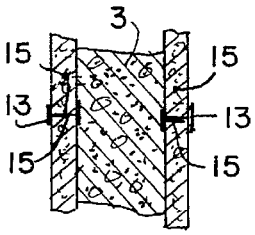
FIG. 11
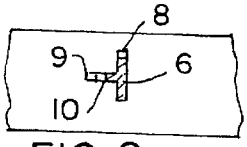
FIG. 8
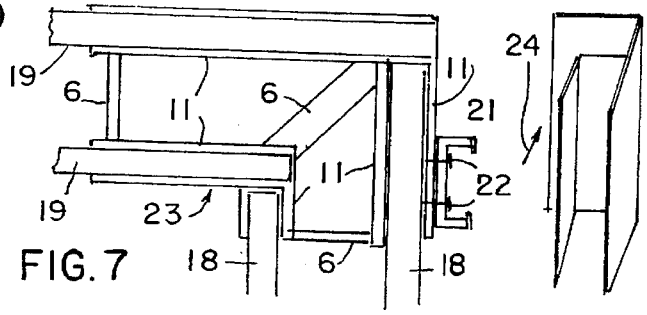
FIG. 7

FOAM AND CHANNEL CONCRETE FORM SYSTEM

BACKGROUND OF THE INVENTION

This invention relates to prefabricated forming elements for construction of reinforced concrete building walls, and methods of wall construction employing those elements.

Conventional forming for poured reinforced concrete walls employed heavy plywood panels clamped and nailed into place with tie rods between parallel panels to prevent them from spreading apart under the hydraulic forces. The plywood was treated so that it could be stripped away after the concrete had set. If the wall was to be insulated, insulation would then be fastened to one or both faces of the concrete. Rigid foam plastic panels have been shown to be strong enough to substitute for plywood. It has the distinct advantage that it may be left in place after pouring to serve as permanent rigid insulation for the wall.

U.S. Pat. No. 5,040,344 issued Aug. 20, 1991 to Durand discloses a foam panel forming system. Horizontal T beam stiffeners fit into slots cut in the panels. Vertical shores are attached to the stiffeners on one side and ties join the stiffeners of one side to the stiffeners of the second side. This is a costly and labor intensive system, panels must be especially prepared for the stiffeners.

U.S. Pat. No. 4,936,540 issued Jun. 26, 1990 to Boeshart teaches tie elements which may be forced through the panels, and walers which may then be attached to the outboard ends of the ties. He also teaches the ties supporting horizontal reinforcing rods. This is a labor intensive system with no provision being made for maintaining vertical alignments of overlying or adjacent panels.

The DIAMOND SNAP-FORM™ Expanded Polystyrene Concrete Forming System provided by AFM corporation of Excelsior, Minn. provides a special molded tie which holds the inner and outer faces of the two parallel foam panels in secure spaced apart relationship. These ties fit into slots specially cut in the long edges of the panels spaced one foot apart in 1×8 foot panels. These ensure horizontal and vertical alignment of the panels and the tie portion between panels is provided with molded support for horizontal reinforcing rods. It requires that the panels have slots cut in the edges every foot. It provides no support between the ties, relying instead on the strength and integrity of the foam edges to hold the fluid concrete in place. The system limits the pour to four feet. For higher walls, repeat pours must be made after the lower portion has set to reduce hydraulic pressure on the panels at their edges.

SUMMARY OF THE INVENTION

It is accordingly an object of the invention to provide a foam panel concrete forming system that requires very little labor and skill, that employs foam panels that need no special cutting or treatment prior to their use. It is another object that the system hold the entire edges of adjacent panels together so that the integrity of the form assembly is not compromised by unsupported edges. It is yet another object that means be provided for enhanced support of both vertical and horizontal reinforcing rods. It is yet another object to provide sturdy exposed surfaces for the enhanced attachment of finishing panels such as gypsum drywall.

The forming system of the invention comprises I-beam channels for receiving and holding in position adjacent horizontal edges of the foam panels along their entire edges. A pair of I-beams are held parallel to one another and spaced apart by a plurality of rigid tie elements having a length equal to the thickness of the concrete wall to be poured. The tie elements are further provided with means for holding steel reinforcing rods in position. The system may also provide I-beam connection between adjacent vertical edges of the panel so that substantially all of the adjacent edges of the foam panels are secured by rigid channels for greatly enhanced security of the forming system. The I-beam flanges may be used to support lath or drywall screw fasteners.

These and other objects, advantages and features of the invention will become more apparent when the detailed description is studied in conjunction with the drawings, in which like reference characters indicate like elements in the different figures.

BRIEF DESCRIPTION OF THE DRAWINGS

FIG. 1 is a perspective view of a horizontal connector of the invention.

FIG. 2 is a sectional view through line 2—2 of FIG. 1.

FIG. 3 is a sectional view through line 3—3 of FIG. 1.

FIG. 4 is a front elevation view of a poured concrete wall incorporating the foam panel form system of the invention.

FIG. 5 is a sectional view taken through line 5—5 of FIG. 4.

FIG. 6 is a sectional view taken through line 6—6 of FIG. 4.

FIG. 7 is a top view of a corner connector.

FIG. 8 is a sectional view taken on line 8—8 of FIG. 1.

FIG. 9 is a perspective view of a portion of another embodiment of the connector of the invention.

FIG. 10 is a perspective view of a portion of the connector of FIG. 9 with a reinforcing rod holder in place.

FIG. 11 is a perspective view of a vertical corner connector.

DETAILED DESCRIPTION OF PREFERRED EMBODIMENTS

Referring now first to FIGS. 1–8, the concrete forming system of the invention comprises a set of light-weight, thermally insulating panels 2 such as rigid foamed plastic well known in the art, as exemplified by polystyrene. These may be 1×8 feet and 2 inches thick. These are held in place by connectors 1 to form a pair of parallel walls spaced apart to delimit therebetween a space which is intended to be filled with concrete 3 and reinforcing steel rods The connector 1 comprises a pair of I beams 5 held together spaced apart relationship by s plurality of tie elements 6 that are rigid enough to hold horizontal reinforcing bars 4. The tie elements 6 have V notches 7 on their upper edges 8 to hold horizontal reinforcing bars of various diameters in position. The tie element has a horizontal member 9 with apertures 10 to hold vertical reinforcing bars in position.

Each I-beam 5 has flanges 11 spaced apart by web 12 such that the horizontal edges 14 of the foam panels will fit snugly therein to form a seal to an upper panel and a lower panel as well as holding the panels in vertical alignment.

Vertical I-beams 13 seal and join together vertical edges 15 of the foam panels. These vertical I beams 13 may also be joined together by tie elements if desired, but this may not be necessary when sufficient tie elements are provided on the horizontal connectors.

Because substantially all of the edges of the foam panels are sealed and joined together by the horizontal and vertical I beams, the hydraulic forces of the fluid concrete are taken up by connectors. When these I-beams are made of a strong solid plastic, such as a polyolefin or polyvinylchloride, they can withstand a greater head of concrete than simple abutted foam edges.

The plastic gridwork formed by the I beams is locked into the concrete wall. It provides an excellent support into which various fasteners may be inserted to support surface panels, drywall, and the like.

The first course of panels may be supported on a footing by connectors 17 in which the I-beams at each end of the tie elements is replaced by a single channel as indicated by the phantom lines 16 in FIG. 2 cutting off the bottom flanges. The same type of connectors may be employed inverted for the top cap of a wall so that the concrete can be screeded in a common plane with the webs of the upper connectors 17. FIGS. 7, 11 show corner connectors 23 and 24 in which the edges of the foam panels are supported at the corner where the edge of one panel 18 is abutted to the side of its adjoining panel 19 to form a continuously insulated and supported corner without specially constructed corner panels.

In an alternative embodiment shown in FIGS. 9 and 10, the tie element 6 is a simple bar joining the two I-beams 5. Means for supporting a vertical or horizontal reinforcing bar 4 at selected positions along the tie element are provided by metal spring clips 20 which snap onto the tie element as required.

The connectors are preferably fabricated from a low thermal conductivity plastic such as polyolefin or polyvinyl chloride where thermal insulation is important and may be made of metal in other circumstances. Because the flanges of the I-beams and channels cover the entire top and bottom edges of the panels, the forces tending to spread them apart are distributed over a far greater length and area than the prior art spaced apart supports. This eliminates the need to make cuts and slots in the foam panel to pass the members joining outer flanges required by the prior art connectors.

The flanges 11 are sturdy enough that braces and shorings may be fastened to them as indicated by a sheet metal stud 21 temporarily screwed to flange 11 by screws 22 in FIG. 7.

The two parallel form walls need not be made with the same thickness of panels. For example, the inner form wall may be made with 2 inch thick panels and the outer form wall with 4 inch panels. The connectors would have corresponding I beam-dimensions.

The above disclosed invention has a number of particular features which should preferably be employed in combination although each is useful separately without departure from the scope of the invention. While I have shown and described the preferred embodiments of my invention, it will be understood that the invention may be embodied otherwise than as herein-specifically illustrated or described, and that certain changes in the form and arrangement of parts and the specific manner of practicing the invention may be made within the underlying idea or principles of the invention within the scope of the appended claims.

What is claimed is:

1. A concrete wall forming structure comprising:

a first concrete impervious form wall and a second concrete impervious form wall substantially parallel to one another and spaced apart from one another to define a space therebetween arranged to receive and hold reinforcing rods and poured concrete, each form wall comprised of a plurality of rigid foam panels, each panel having a length, a height, and a width dimension, each panel having a top and a bottom planar surface extending in the length and width dimension and separated from one another by the height dimension, each panel having opposed planar side surfaces extending in the height and width dimensions and separated from one another by the length dimension, each panel having broad front and back planar opposed faces, and each panel positioned in one of the form walls with its height dimension extending generally vertically and its length dimension extending generally horizontally, the foam panels disposed on top of one another and in side to side relation to thereby provide a form wall, the panels of the first form wall being spaced apart from and unattached to, the panels of the second form wall;

a plurality of horizontal connector means for interlocking the bottom surface of an upper panel with the top surface of a lower panel upon which it is disposed in a concrete impervious connection, each horizontal connector means comprising first and second elongate horizontal I beam channels for securing the panels of the first and second form walls respectively, each horizontal I beam channel having a web with upper and lower faces adapted to engage the bottom and top surfaces respectively, the horizontal I beam channel having flanges adapted to snugly engage the front and back faces of the panels adjacent the top and bottom surfaces in concrete impervious engagement, each horizontal connector means provided with a plurality of spaced apart tie elements extending between the first and second I beam channels and directly attached thereto, the tie elements holding the horizontal I beam channels apart at a predetermined distance to thereby define the space to be filled by the poured concrete and to resist relative movement between the first and second form walls; and support means connected to the tie elements for supporting reinforcing rods within the space between the form walls.

2. The wall forming structure according to claim 1, further comprising a plurality of vertical connector means for interlocking the side surfaces of side by side adjacent panels together in a concrete impervious connection, each vertical connector means comprising an elongate vertical I beam channel having a web with opposed side faces adapted to engage the side surfaces of adjacent panels, and having flanges adapted to snugly engage the front and back faces of the adjacent panels in concrete impervious engagement.

3. The wall forming structure according to claim 2, in which the vertical connector means comprises two of the elongate vertical I beam channels joined by at least one tie member holding the two vertical I beam channels in spaced apart relation.

4. The wall forming structure according to claim 1, further comprising a plurality of top and bottom course connectors, each connector comprising an elongate U channel having a web width substantially equal to the width dimension for engaging a bottom or top surface of a panel, and having flanges for snugly engaging the front and back faces of a panel adjacent the top or bottom surfaces in concrete impervious engagement.

5. The wall forming structure according to claim 2, further comprising a vertical corner connector having an elongate first U channel having a first web and opposed parallel first flanges, and an elongate second U channel having a second web and opposed parallel second flanges, the first and second webs having a width substantially equal to the width dimension so as to snugly engage the side surfaces of adjacent corner panels, the second U channel being arranged orthogonal to the first U channel with one of the first flanges serving at least in part as the web of the second U channel.

6. The wall forming structure according to claim 1, in which the panels are form plastic and the connector means are plastic.

7. The wall forming structure according to claim 4, further comprising a plurality of spaced apart course tie members extending between, and joined to, first and second course connectors, the course tie members holding the U channels apart at said predetermined distance for supporting the first and second form walls.

8. A concrete wall forming structure comprising:

a first concrete impervious form wall and a second concrete impervious form wall substantially parallel to one another and spaced apart from one another to define a space therebetween arranged to receive and hold reinforcing rods and poured concrete, each, form wall comprised of a plurality of rigid foam panels, each panel having a length, a height, and a width dimension, each panel having a top and a bottom planar surface extending in the length and width dimension and separated from one another by the height dimension, each panel having opposed planar side surfaces extending in the height and width dimensions and separated from one another by the length dimension, each panel having broad front and back opposed planar faces, and each panel positioned in one of the form walls with its height dimension extending generally vertically and its length dimension extending generally horizontally, the foam panels disposed on top of one another and in side to side relation to thereby provide a form wall, the panels of the first form wall being spaced apart from, and unattached to, the panels of the second form wall; and a plurality of horizontal connector means for interlocking the bottom surface of an upper panel with the top surface of a lower panel upon which it is disposed in a concrete impervious connection, each horizontal connector means comprising first and second elongate horizontal I beam channels for securing the panels of the first and second form walls respectively, each horizontal I beam channel having a web with upper and lower faces adapted to engage the bottom and top surfaces respectively of the upper and lower panels respectively, the horizontal I beam channel having flanges adapted to snugly engage the front and back faces of the panels adjacent the top and bottom surfaces in concrete impervious engagement, each horizontal connector means provided with a plurality of spaced apart tie elements extending between the first and second I beam channels and directly attached thereto, the tie elements holding the horizontal I beam channels and the panels attached thereto apart at a predetermined distance to thereby define the space to be filled by the poured concrete and to resist relative movement between the first and second form walls.

9. The concrete wall structure according to claim 8, further comprising reinforcing rod support means connected to the tie elements for supporting reinforcing rods within the space between the first and second form walls.

10. The wall forming structure according to claim 9, further comprising:

a plurality of vertical connector means for interlocking the side surfaces of side by side adjacent panels together in a concrete impervious connection, each vertical connector means comprising an elongate vertical I beam channel having a web with opposed side faces adapted to engage the side surfaces of adjacent panels and having flanges adapted to snugly engage the front and back faces of the adjacent panels in concrete impervious engagement.

11. The wall forming structure according to claim 10, in the vertical connector means comprises two of the elongate vertical I beam channels joined by at least one tie member holding the two vertical I beam channels in spaced apart relation.

12. The wall forming structure according to claim 8, further comprising a plurality of top and bottom course connectors, each connector comprising an elongate U channel having a web width substantially equal to the width dimension for engaging a bottom or top surface of a panel, and having flanges for snugly engaging the front and back faces of a panel adjacent the top or bottom surfaces in concrete impervious engagement.

13. The wall forming structure according to claim 10, further comprising a vertical corner connector having an elongate first U channel having a first web and opposed parallel first flanges, and an elongate second U channel having a second web and opposed parallel second flanges, the first and second webs having a width substantially equal to the width dimension so as to snugly engage the side surfaces of adjacent corner panels, the second U channel being arranged orthogonal to the first U channel with one of the first flanges serving at least in part as the web of the second U channel.

14. The wall forming structure according to claim 12, further comprising a plurality of spaced apart course tie members extending between, and joined to, first and second course connectors, the course tie members holding the U channels apart at said predetermined distance for supporting the first and second form walls.

* * * * *